US009750364B2

(12) United States Patent
Lawson et al.

(10) Patent No.: US 9,750,364 B2
(45) Date of Patent: Sep. 5, 2017

(54) ENTRANCE MAT

(71) Applicant: Hendrick Screen Company, Owensboro, KY (US)

(72) Inventors: Steve Lawson, Maceo, KY (US); Brenda McCarty, Calhoun, KY (US)

(73) Assignee: Hendrick Screen Company, Owensboro, KY (US)

( * ) Notice: Subject to any disclaimer, the term of this patent is extended or adjusted under 35 U.S.C. 154(b) by 481 days.

(21) Appl. No.: 14/203,668

(22) Filed: Mar. 11, 2014

(65) Prior Publication Data

US 2014/0272288 A1 Sep. 18, 2014

Related U.S. Application Data

(60) Provisional application No. 61/876,997, filed on Sep. 12, 2013, provisional application No. 61/801,878, filed on Mar. 15, 2013.

(51) Int. Cl.
*A47L 23/24* (2006.01)
*A47G 27/02* (2006.01)
*A47G 27/04* (2006.01)

(52) U.S. Cl.
CPC ..... *A47G 27/0206* (2013.01); *A47G 27/0418* (2013.01); *A47L 23/24* (2013.01); *Y10T 428/24331* (2015.01)

(58) Field of Classification Search
CPC ..... A47G 27/0206; A47L 23/24; Y10T 428/24339; Y10T 428/24008
USPC ..... 15/215
See application file for complete search history.

(56) References Cited

U.S. PATENT DOCUMENTS 3,805,955 A 4/1974 Bixby et al.
3,901,801 A 8/1975 Bixby
4,002,540 A 1/1977 Bixby
4,283,278 A 8/1981 Savage et al.
4,588,628 A * 5/1986 Roth ..... A47G 27/0412 296/97.23
4,796,399 A * 1/1989 Kessler ..... A47L 23/26 15/215
5,243,804 A * 9/1993 Therrien ..... E04C 2/423 15/215
5,476,179 A 12/1995 Jones et al.
5,560,496 A 10/1996 Lynn
5,687,853 A 11/1997 Askew
6,319,584 B1 * 11/2001 Kessler ..... A47G 27/0418 428/100
6,426,003 B2 7/2002 May et al.
6,915,910 B2 7/2005 Lutz et al.
(Continued)

*Primary Examiner* — William P Watkins, III
(74) *Attorney, Agent, or Firm* — Thomas E. Lees, LLC

(57) ABSTRACT

A mat comprises a profile bar, a metal strip with a high coefficient of friction, a U-clip, and a rivet rod is disclosed. The profile bar includes a head with a flat surface and a post including a hole. The metal strip includes a surface with a high coefficient of friction, and a plurality of posts opposite the surface with the high coefficient of friction, wherein the plurality of posts includes a hole. The rivet rod fits through the hole in the post of the profile bar and the hole of the plurality of posts of the metal strip. The U-clip includes notches, and the post of the profile bar rests in one of the notches while the plurality of posts of the metal strip rests in several of the notices. The rivet rod extends through the holes to couple the profile bar and the metal strip to the U-clip.

12 Claims, 6 Drawing Sheets

(56) References Cited

U.S. PATENT DOCUMENTS

| | | | | |
|---|---|---|---|---|
| 6,922,896 | B2 | 8/2005 | Choi | |
| 7,188,733 | B2 | 3/2007 | May et al. | |
| 8,281,933 | B2 | 10/2012 | Gronvall et al. | |
| 2002/0031639 | A1* | 3/2002 | Ullman | A47L 23/26 428/99 |

* cited by examiner

ENTRANCE MAT

CROSS REFERENCE TO RELATED APPLICATIONS

This application claims the benefit of U.S. Provisional Patent Application Ser. No. 61/876,997, filed Sep. 12, 2013, entitled ENTRANCE MAT, the disclosure of which is hereby incorporated by reference, and U.S. Provisional Patent Application Ser. No. 61/801,878, filed Mar. 15, 2013, entitled CARPET PANEL, the disclosure of which is hereby incorporated by reference.

BACKGROUND

The present invention relates in general to entrance mats, and in particular to an entrance mat of profile bar.

Certain floor areas, such as entranceways to buildings and offices, are subject to heavy usage. As such, it is often desirable to provide a floor covering in those heavy usage areas.

BRIEF SUMMARY

According to aspects of the present disclosure, a mat comprises a profile bar, a metal strip with a high coefficient of friction, a U-clip, and a rivet rod. The profile bar includes a head with a flat surface and a post including a hole. The metal strip includes a surface with a high coefficient of friction and a plurality of posts opposite the surface with the high coefficient of friction, and the plurality of posts includes a hole. Further, the rivet rod is sized to fit the hole in the post of the profile bar and the hole of the plurality of posts of the metal strip. The U-clip includes notches, and the post of the profile bar rests in one of the notches of the U-clip while the plurality of posts of the metal strip rests in several of the notches of the U-clip. The rivet rod extends through the holes to couple the profile bar and the metal strip to the U-clip.

According to further aspects of the present disclosure, a mat comprises a profile bar including a head. The mat further includes a metal strip with a surface having a high coefficient of friction, wherein the metal strip includes a width. Further, the metal strip couples to the profile bar via welding tacks.

According to still further aspects of the present disclosure, a mat comprises a first profile bar, a second profile bar, U-clip, and a rivet rod. Both the first profile bar and the second profile bar include a head with a flat surface and a post including a hole. Further, the second profile bar includes a coating with a high coefficient of friction on its flat surface. Moreover, the rivet rod is sized to fit the hole in the posts of the profile bars. The U-clip includes notches, and the posts of the first profile bar and the second profile bar rest in one of the notches of the U-clip. To couple the profile bars to the U-clip, the rivet rod extends through the hole of the first profile bar and the hole of the second profile bar.

DETAILED DESCRIPTION

According to various aspects of the present disclosure, an entrance mat includes a profile bar interposed between strips with a high coefficient of friction, profile bar that includes a surface with a high coefficient of friction, or both. The profile bar and high-friction surfaces are coupled together using U-clips and rivet rods to form a screen, which may be used as a slip-resistant walking surface.

Figure 1B:
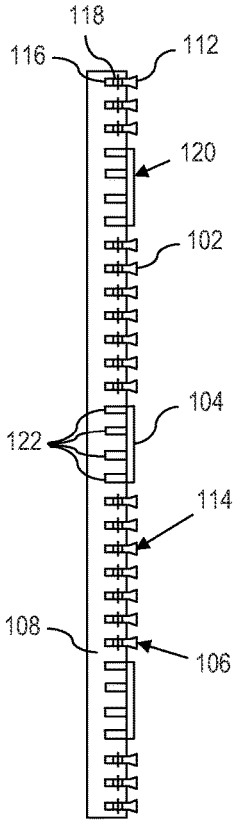
FIG. 1B is a side view of the entrance mat of FIG. 1A, according to various aspects of the present disclosure.
Figure 1A:
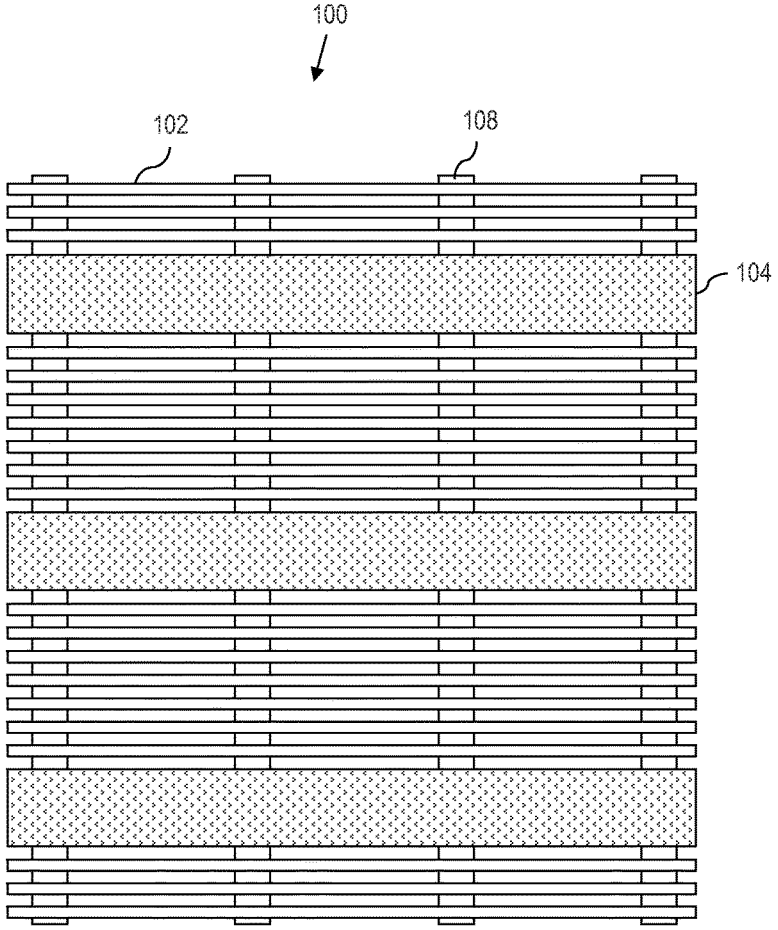
FIG. 1A is a top view of an entrance mat, according to various aspects of the present disclosure.
Figure 1C:
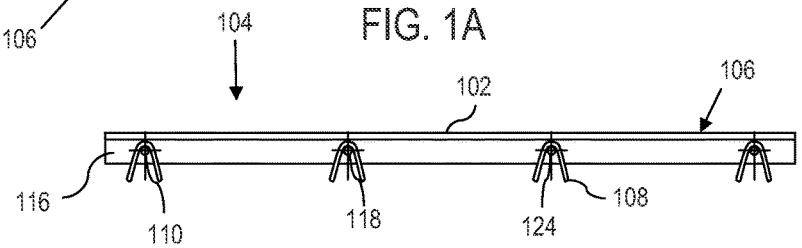
FIG. 1C is a front view of the entrance mat of FIGS. 1A and 1B, according to various aspects of the present disclosure.

Turning now to the figures, and in particular to FIGS. 1A-1C, an embodiment of an entrance mat 100 is shown. As mentioned above, FIG. 1A is a top view, FIG. 1B is a side view, and FIG. 1C is a front view of the entrance mat 100, which includes profile bar 102 and a high-friction surface 104 that combine to make a generally level walking surface 106. The profile bar 102 and the high-friction surface 104 couple with a U-clip 108 and a rivet rod 110 to create the entrance mat 100 (which is discussed in greater detail below in reference to FIG. 4).

Figure 4:
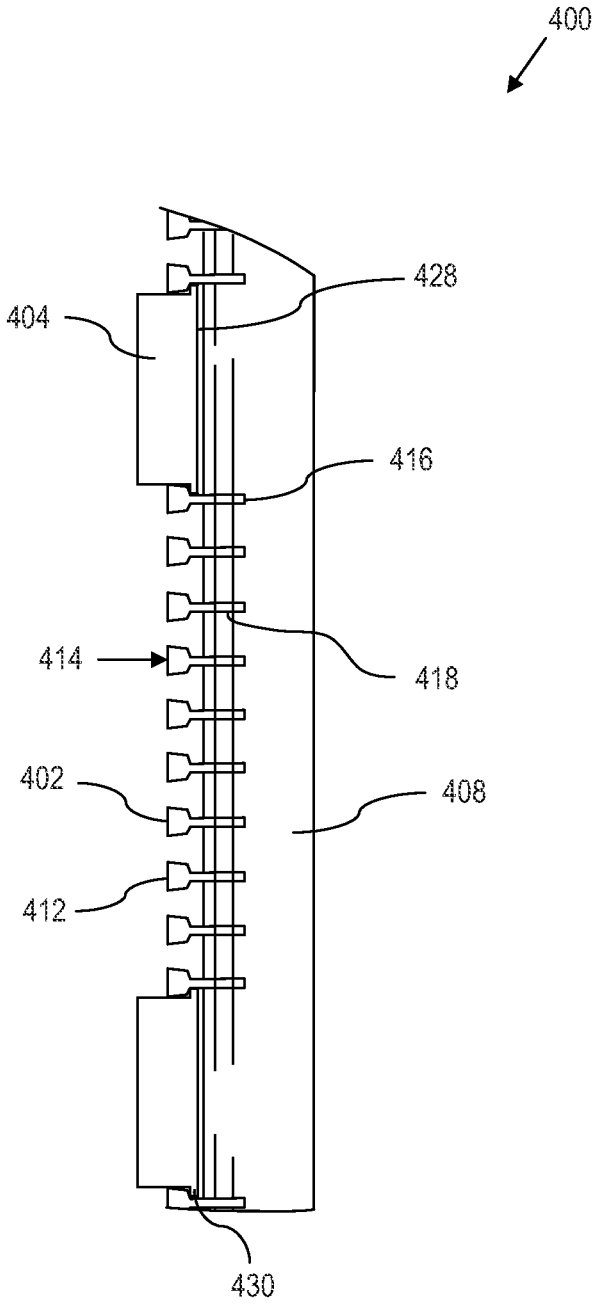
FIG. 4 is a side view of a fourth embodiment of the entrance mat including a backing for replaceable carpet strips, according to various aspects of the present invention.
Figure 5:
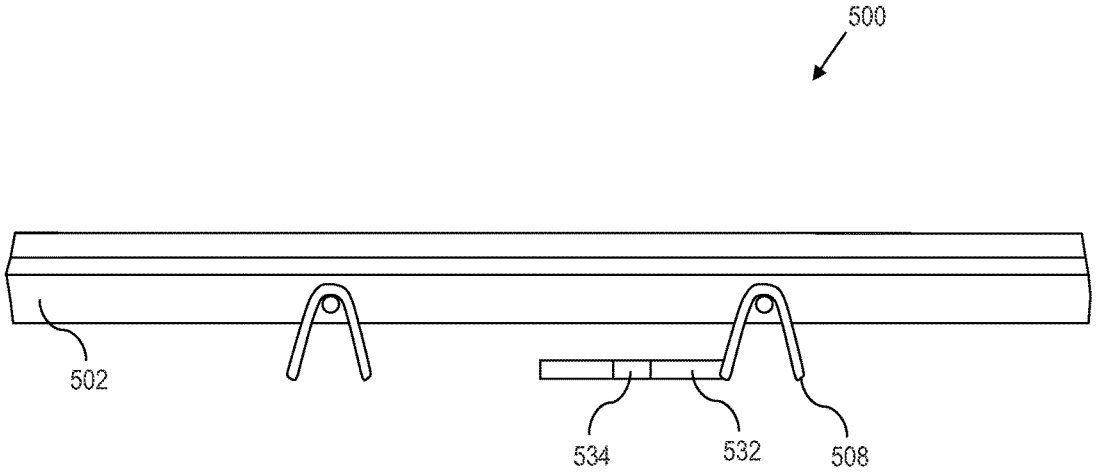
FIG. 5 is a front view of an embodiment of the entrance mat including mounting tabs.
Figure 6:
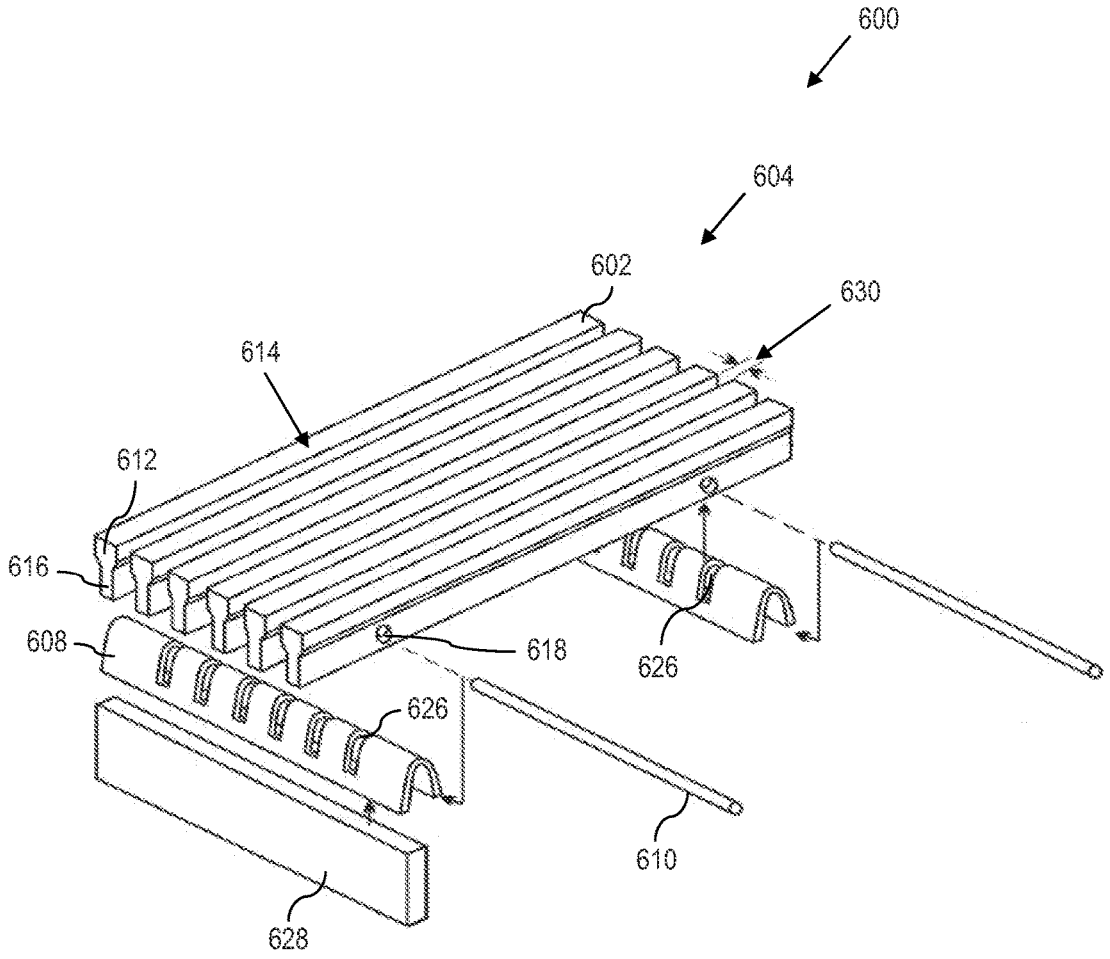
FIG. 6 is an exploded view of an embodiment of an entrance mat, according to various aspects of the present disclosure.

Turning to FIG. 1B specifically, the profile bar 102 includes a head 112 with a flat surface 114 and further includes a post 116 with a hole 118. As shown in FIGS. 1A-1C, the profile bar 102 is a B-type profile bar (i.e., a triangular head). However, other types of profile bar may be used (e.g., a T-type profile bar (as shown in FIGS. 4-6 below)). The head 112 and the post 116 run the entire length of the profile bar 102 generally uniformly. In other words, a cross section at any point along the length of the profile bar 102 will be generally similar to a cross section at any other point along the profile bar 102 (with the exception of the holes).

The high-frictional surface 104 can be any type of high-frictional surface (e.g., carpeting, a metal strip including a surface coated with a coating having a high coefficient of friction such as a SlipNOT® coating, etc.). SlipNOT is a registered trademark of W.S. Molnar Company of 2545 Beaufait Street, Detroit, Mich. 48207. Further, the high-frictional surface includes a plurality of posts 122 including holes 124 similar to the posts 116 and holes 118 of the profile bar 102.

In the embodiment of FIGS. 1A-1C, the high-friction surface 104 includes four posts 122 equally spaced apart. However, any number of posts 122 may be used, and the spacing between the posts may be any desired spacing—uniform or not. Moreover, in the embodiment of FIGS. 1A-1C, the ratio of profile bars 102 to high-frictional surfaces 104 is about seven-to-one. However, other ratios may be used.

As shown in FIG. 1B, the high-frictional surface 104 is below the flat surface 114 of the head 112 of the profile bar 102. However, the high-friction surface 104 may be generally flush with the flat surface 114 of the head 112 of the profile bar 102 or may be above the flat surface 114 of the head 112 of the profile bar 102.

Further, the mat 100 may have mounting tabs as discussed in FIG. 5 below.

Figure 2B:
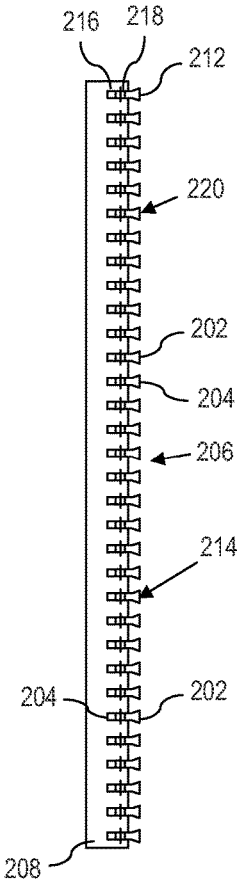
FIG. 2B is a side view of the second entrance mat of FIG. 2A, according to various aspects of the present disclosure.
Figure 2A:
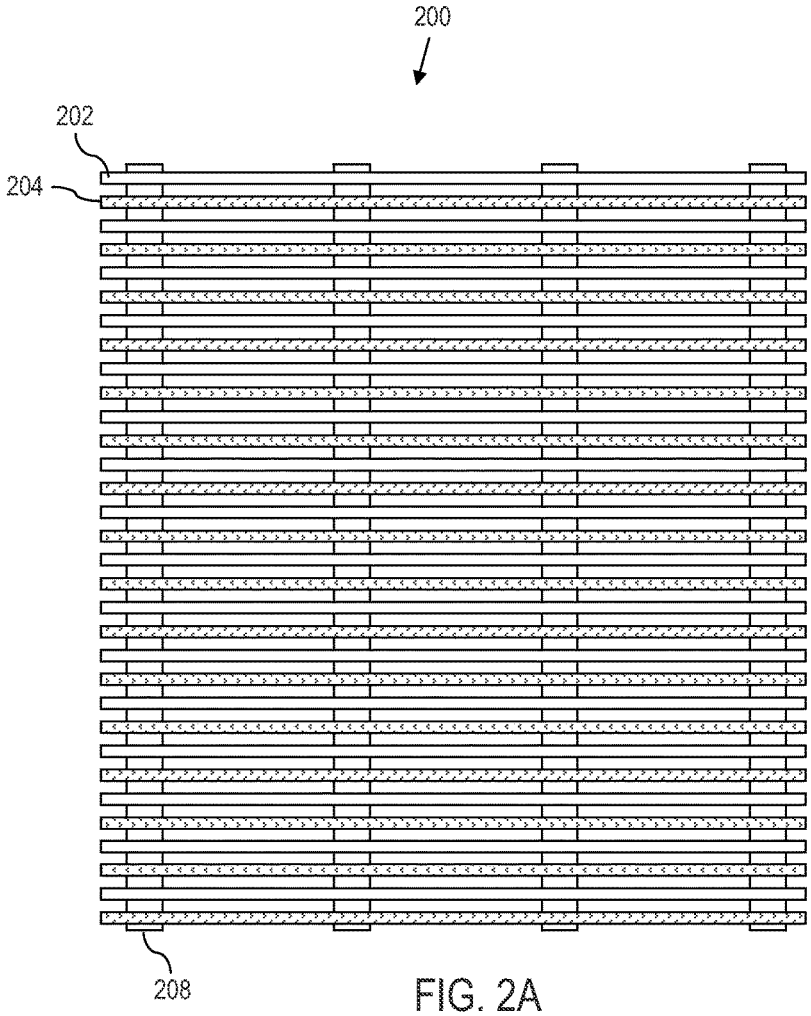
FIG. 2A is a top view of a second embodiment of an entrance mat, according to various aspects of the present disclosure.
Figure 2C:
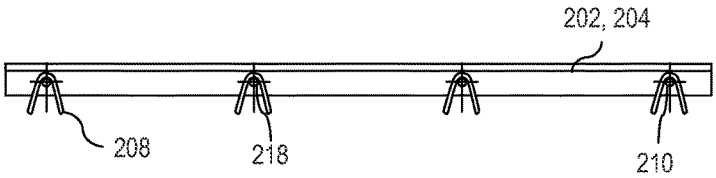
FIG. 2C is a front view of the second entrance mat of FIGS. 2A and 2B, according to various aspects of the present disclosure.

Turning now to FIGS. 2A-2C, another embodiment of an entrance mat 200 is shown. In this embodiment, several profile bars 202, 204 are coupled together to create a walking surface 206 using U-clips 208 and rivet rods 210 (as described in greater detail below in reference to FIG. 6). As with the embodiment shown in FIGS. 1A-1C, the profile bars 202, 204 include a head 212 with a flat surface 214 and a post 216 with a hole 218. Further, the flat surface 214 of every other profile bar 204 includes a coating with a high coefficient of friction to create a high-frictional surface 220. As such, the uncoated profile bars 202 alternate with the coated profile bars (i.e., high-frictional surfaces) 204 on a one-to-one basis. However, other alternating patterns and ratios of uncoated profile bars 202 to coated profile bars 204 may be used.

Further, as with the embodiment of FIGS. 1A-1C, the profile bars 202, 204 may be any type (e.g., B-type, T-type, etc.); the uncoated profile bars 202 may be above, below, or generally flush with the coated profile bars 204; and the mat 200 may include mounting tabs described below in reference to FIG. 5.

Figure 3:
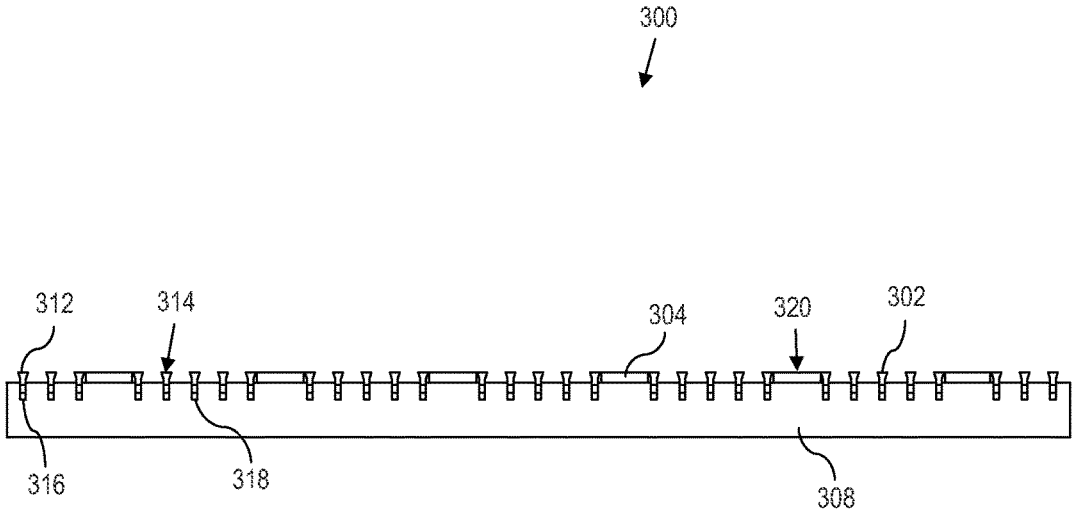
FIG. 3 is a side view of a third embodiment of an entrance mat, according to various aspects of the present disclosure.

Turning now to FIG. 3, a side view of another embodiment of a mat 300 is shown. As with the previous two embodiments (100, FIGS. 1A-1C; 200, FIGS. 2A-2C), the mat 300 includes a profile bar 302 and a high-frictional surface 304. The profile bar 302 includes a head 312 with a flat surface 314 and a post 316 with a hole 318. While the high-frictional surface 304 includes a high coefficient of friction, the high-frictional surface 304 does not include posts. Instead, the high-frictional surface 304 can be a metal strip that slides into place and remains in place via welding tacks (not shown) to edges of the profile bar 302.

As shown in FIG. 3, the ratio of the profile bars 302 to the high-frictional surface 304 is about five-to-one. However, any desired ratio may be implemented. Moreover, as shown the U-clip 308 does not include a notch (see FIG. 4 below) at points where the high-frictional surface 304 rests; however, there may be a notch at those points.

Further, as with the embodiment of FIGS. 1A-1C, the profile bars 302 may be any type (e.g., B-type, T-type, etc.); the profile bars 302 may be above, below, or generally flush with the high-frictional surface 304; and the mat 300 may include the mounting tabs described below in reference to FIG. 5.

Turning now to FIG. 4, a side view of another embodiment of a mat 400 is shown. As with the previous embodiments, the mat 400 includes a profile bar 402 and a high-frictional surface 404. The profile bar 402 includes a head 412 with a flat surface 414 and a post 416 with a hole 418. While the high-frictional surface 404 includes a high coefficient of friction, the high-frictional surface 404 does not include posts. Instead, the high-frictional surface 302 can be a strip (e.g., a carpet strip, a metal strip with SlipNOT, etc.) that slides into a backer 428 that is coupled to a U-clip 408 via welding tacks (not shown). Any number of welding tacks may be used to couple the backer 428 to the U-clip (e.g., four tacks (one on each corner), more tacks, or less tacks).

When the backer 428 is coupled to the U-clip 408, there is a pocket (i.e., a space) between the head 412 of the profile bar 402 and the backer 428. The high-frictional surface 404 includes tabs 430 that slide within that pocket such that the heads 412 help keep the high-frictional surface 404 in place. The tabs 430 may be of any material (e.g., nylon, rubber, identical material to the high-frictional surface, etc.).

The backer 428 is implemented as a strip that can be made different sizes, spacing, or both to accommodate different carpet strips.

As shown in FIG. 4, the ratio of profile bars 402 to high-frictional surface 404 is about ten-to-one. However, any desired ratio may be implemented. Moreover, as shown the U-clip 408 does not include a notch (see FIG. 6 below) at points where the high-frictional surface 404 rests; however, there may be a notch at those points.

Further, as with the embodiment of FIGS. 1A-1C, the profile bars 402 may be any type (e.g., B-type, T-type, etc.); the profile bars 402 may be above, below, or generally flush with the high-frictional surface 404; and the mat 400 may include mounting tabs described below in reference to FIG. 5.

FIG. 5 is a front view of a mat 500 (e.g., mats 100, 200, 300, 400 described above) where a U-clip 508 includes a mounting tab 532, which allow the mat 500 to be secured to a walking surface. For example, a tab from a corresponding walking surface is interposed between the bottom of the profile bar 502 and the mounting tab 532. As another example, the mounting tab 532 may include a hole 534 that allows a coupler (e.g. bolt, screw, rivet, etc.) to couple the mat to the walking surface. As shown, not every U-clip 508 is necessarily required to include a mounting tab 532. Further, as described above, the mounting tabs 532 are optional.

FIG. 6 illustrates a principle of assembling a mat 600 using profile bar 602 (illustrated as T-type profile bar, but may be B-type profile bar instead), U-clips 608, and rivet rods 610. The assembly principle can also be applied to high-frictional surfaces 604 with posts 616 discussed herein (e.g., the metal strip of the embodiment of FIGS. 1A-1C and the coated profile bar 204 of FIGS. 2A-2C).

As mentioned above, the profile bars 602 have posts 616 with holes 618, and the rivet rods 610 are sized to fit the holes 618 (and the holes (124, FIG. 1C) of the high frictional surface of FIGS. 1A-1C). Further, the U-clip 608 includes notches 626 with a width of approximately the width of the posts 616 of the profile bar 602. The profile bars 602 rest in the notches 626 of the U-clip 608, and the rivet rods 610 extend through the holes to keep the profile bars 602 from moving vertically. An optional support bar 628 may also be placed within the U-clip 608 to provide extra strength to the mat 600.

The notches 626 are spaced apart by a width of the head 612 of the profile bar 602 plus a desired gap 630 width. As shown, the notches 626 are evenly spaced; however, the notches 626 may be unevenly spaced to provide different gap 630 widths, different head 612 widths, different width between posts of the high-frictional surface, etc., or combinations thereof.

The mats 100, 200, 300, 400, 500 described herein provide a cosmetically pleasing entrance mat that still provides enough traction to prevent a walker from slipping while walking on the mat. As such, the walking surface of the mats may be level (e.g., not curved slightly). In turn, the level walking surface (and non-curved U-clips) provides for an easy manufacturing process and assembly. Further, debris may fall through the gaps within the mats and will be less likely to get caught in the gaps of the mat than in gaps of a grate because the heads of the profile bars are sloped inward toward the posts. As such, the gap width increases as the debris falls through the gap.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The description of the present invention has been presented for purposes of illustration and description, but is not intended to be exhaustive or limited to the invention in the form disclosed. Many modifications and variations will be apparent to those of ordinary skill in the art without departing from the scope and spirit of the invention.

Having thus described the invention of the present application in detail and by reference to embodiments thereof, it will be apparent that modifications and variations are possible without departing from the scope of the invention defined in the appended claims.

What is claimed is:

1. A mat comprising:
a profile bar including:
a head including a flat surface; and
a post including a hole;
a metal strip including:
a surface with a high coefficient of friction; and
a plurality of posts opposite the surface with the high coefficient of friction, wherein the plurality of posts includes a hole;
a U-clip including notches;
a rivet rod sized to fit the hole in the post of the profile bar and the hole of the plurality of posts;
wherein:
the post of the profile bar rests in one of the notches of the U-clip;
the plurality of posts of the metal strip rests in several of the notches of the U-clip; and
the rivet rod extends through the hole of the profile bar and the hole of the metal strip to couple the profile bar and the metal strip to the U-clip.

2. The mat of claim 1, wherein the plurality of posts of the metal strip includes four posts and each of the four posts includes a hole.

3. The mat of claim 1, wherein a ratio of profile bars to metal strips is about 7 to 1.

4. The mat of claim 1, wherein the profile bar is a B-type profile bar.

5. The mat of claim 1, wherein the profile bar is a T-type profile bar.

6. The mat of claim 1, wherein:
the head of the profile bar includes a width; and
the notches of the U-clip are spaced apart greater than the width of the head of the profile bar.

7. The mat of claim 1, wherein the notches of the U-clip are evenly spaced.

8. The mat of claim 1, wherein the notches of the U-clip are unevenly spaced.

9. The mat of claim 1 further including a mounting tab coupled to the U-clip, wherein the mounting tab secures the mat to an associated walking surface.

10. The mat of claim 1, wherein the surface of the metal strip is generally flush with the flat surface of the head of the profile bar when the metal strip and profile bar are coupled to the U-clip.

11. The mat of claim 1, wherein the surface of the metal strip is below the flat surface of the head of the profile bar when the metal strip and profile bar are coupled to the U-clip.

12. The mat of claim 1, wherein the surface of the metal strip is above the flat surface of the head of the profile bar when the metal strip and profile bar are coupled to the U-clip.

* * * * *